United States Patent [19]

Steele

[11] Patent Number: 4,828,529

[45] Date of Patent: May 9, 1989

[54] TUBULAR SOLID BODIED GLOVE PUPPET

[76] Inventor: Charmian N. Steele, Bluebell Cottage, Upper End, Fulbrook, Burford, Oxfordshire 0X8 4BX, United Kingdom

[21] Appl. No.: 126,719

[22] Filed: Nov. 30, 1987

[51] Int. Cl.[4] ..... A63H 3/14; A63H 3/02

[52] U.S. Cl. ..... 446/327; 446/369

[58] Field of Search ..... 446/327, 369, 328, 329, 446/369, 82, 83, 72

[56] References Cited

U.S. PATENT DOCUMENTS

| | | | |
|---|---|---|---|
| 1,865,305 | 6/1932 | Dallas | 446/327 |
| 2,795,896 | 6/1957 | Snyder | 446/329 |
| 3,820,276 | 6/1974 | Goldfarb et al. | 446/327 |
| 3,942,283 | 3/1976 | Rushton | 446/327 |
| 4,244,142 | 1/1981 | Crawford | 446/329 X |
| 4,504,240 | 3/1985 | Thomas | 446/327 X |
| 4,505,687 | 3/1985 | Munro | 446/368 |
| 4,681,555 | 7/1987 | Natiw | 446/327 |
| 4,728,313 | 3/1988 | Thomas | 446/369 |

FOREIGN PATENT DOCUMENTS

| | | | |
|---|---|---|---|
| 922397 | 6/1947 | France | 446/327 |
| 1217387 | 5/1960 | France | 446/327 |
| 2378540 | 8/1978 | France | 446/327 |
| 1515100 | 6/1978 | United Kingdom | 446/327 |
| 2175814 | 12/1986 | United Kingdom | 446/327 |

*Primary Examiner*—Robert A. Hafer
*Assistant Examiner*—D. Neal Muir
*Attorney, Agent, or Firm*—Parkhust, Oliff & Berridge

[57] ABSTRACT

A glove toy having a simple tubular structure which is closed at each end and which, by virtue of an underside opening 6 gives access to the hand in order to allow the toy to be animated in the way of a glove puppet; while at the same time providing, by virtue of a stuffed rear section 9, a sufficiently solid body toy for a child to cuddle. The front end 12 of the tube is folded back inside the interior to form a head and mouth for animation by the hand.

5 Claims, 1 Drawing Sheet

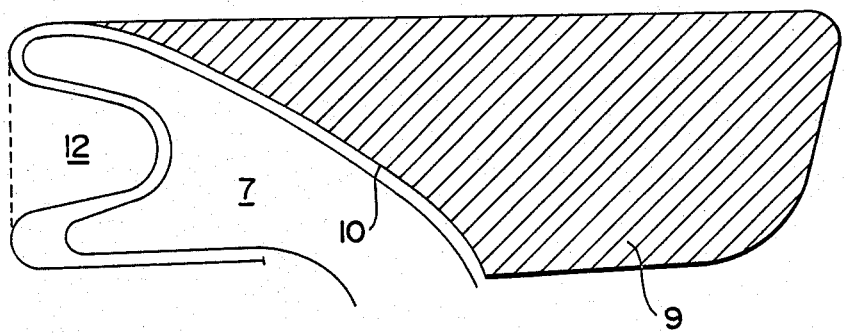
Fig. 1
Fig. 2
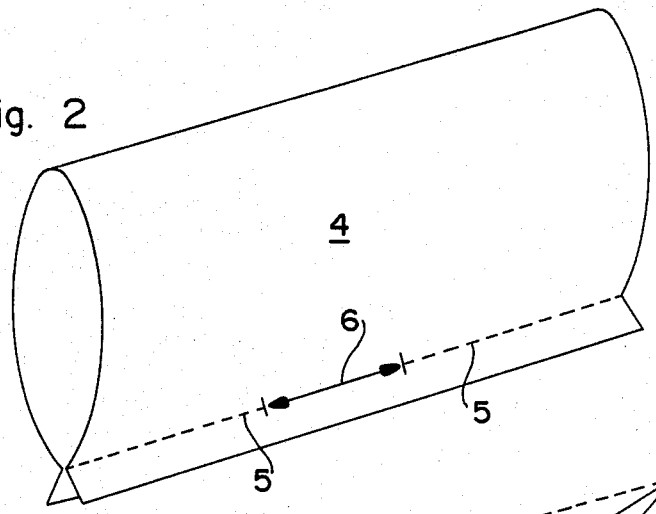
Fig. 3
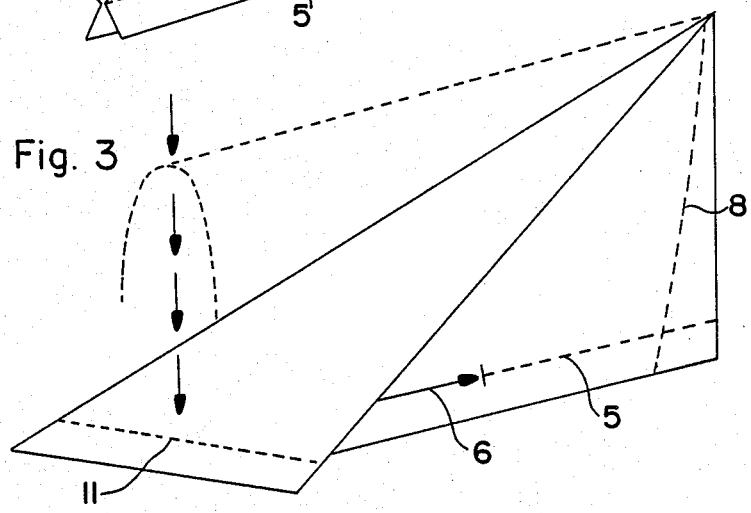

TUBULAR SOLID BODIED GLOVE PUPPET

DESCRIPTION

This inventin relates to a glove toy, or puppet.

BACKGROUND OF THE INVENTION

Glove puppets are well-known as childrens toys and generally comprise a glove/like structure, open at one end, into which a hand can be inserted in order to allow the animation of the character depicted by the main body of the glove through movement of the hand within the glove.

Glove puppets are however of limited use as childrens toys, being fun when animated on the hand, but, when not on the hand, because of their open, empty and limp structure they are disappointing as a soft toy for a child to cuddele.

SUMMARY OF THE INVENTION

An object of the present invention is to provide a glove toy which may be placed on the hand for animation in the manner of a glove puppet, but which also provides a sufficiently solid bodied toy to be of interest to a small child. This object is achieved by the present invention which provides a glove toy comprising a tube of substantially flexible material, wherein said tube is closed off at both ends; an aperture is defined through the side wall of said tube between first and second end parts thereof, to provide access for a human hand into the first end part of said tube and; said second end part is filled with sufficient stuffing to be rendered self supporting. Preferably,t he stuffing extends from the second end part at least partially into said first end part.

In an embodiment, the first end part of the tube is folded back inside itself to form a head and mouth of the toy, for animation by a hand inserted into said first end part through said aperture. By varying the material comrpising the tube and the surface decoration thereof, or by altering the manner in which either end of the tube is closed off, the structure of the glove toy may form the basis for a representation of a wide range of creatures.

BRIEF DESCRIPTION OF THE DRAWINGS

A specific embodiment of the present invention will now be described by way of example only and with reference to the following drawings.

FIG. 1 is a section through a glove toy in accordance with the present invention;

FIG. 2 shows the basic structure of the glove toy shown in FIG. 1; and

FIG. 3 shows the manner in which both ends of the structure shown in FIG. 1 may be closed off.

DESCRIPTION OF THE PREFERRED EMBODIMENTS

Referring to the drawings, the glove puppet/toy comprises a tubular body 4 which is formed by a seam 5, joining together two sides of a piece of cloth. In this context "cloth" may be a single whole piece of cloth or it may be a composite cloth, i.e. a number of pieces of cloth of different colors and/or different textures and/or different shapes sewn together to provide pattern by variation in color or texture or surface contouring.

Part of the way along the seam 5 which runs along the ventral side of the body of the tube, is an aperture 6. The aperture 6 is large enough for a hand 7 to be inserted into the body of the toy. The tube is closed off at one end by a seam 8 to form the rear of the toy and the rear end and upper part of the body is filled with stuffing 9, which is held in place by a lining 10.

At the opposite end, the tube is closed off to form the head of the glove puppet/toy. The top most point of the tube is drawn down to meet the ventral seam and the end of the tube is closed off with a transverse seam 11. When the structure thus formed has been turned inside out so that all seams are on the inside, the closed end of the tube is folded back inside itself to form a mouth 12.

Thus, the invention enables a soft toy to be made, which by virtue of the underside opening, intermediate the ends, can be manipulated to produce the effect of interesting creatures from the animal world and from the world of insects, hitherto unseen in the marketing of toys.

I claim:

1. A toy glove comprising:

a tubular body consisting of two axial ends and a partially closed seam defining an access opening between the axial ends of said tubular body, one of said axial ends being closed to define a first end part, the other of said axial ends being folded back and closed by attachment to said seam to define a second end part;

said tubular body being inverted through said access opening such that the second end part comprises a simulated mouth structure having integral upper and lower jaws manipulated by insertion of a user's hand into said access opening; and the first end part of said tubular body being filled with a sufficient amount of stuffing to render the first end part self supporting.

2. A glove toy as claimed in claim 1 wherein said stuffing extends froms aid first end part, at least partially over said second end part.

3. A glove toy as claimed in claim 1 wherein the tubular body is a woven cloth material.

4. A glove toy as claimed in claim 1 wherein said stuffing is maintained in place by a flexible membrane in said first end part and extending across the interior of said tubular body.

5. A toy glove comprising:

a tubular body comprising two axial ends and a partially closed longitudinal seam defining an access opening between the axial ends of said tubular body, one of said axial ends being closed to define an end part, the other of said axial ends being folded back and closed by attachment to said seam to define a projection part;

said tubular body being inverted through said access opening such that said inverted projection part comprises an simulated mouth structure having integral upper and lower jaw structures manipulated by insertion of a user's hand into said access opening; and the end part of said tubular body including stuffing affixed to said first end part to render said first end part self supporting.

* * * * *

UNITED STATES PATENT AND TRADEMARK OFFICE

CERTIFICATE OF CORRECTION

PATENT NO. : 4,828,529

DATED : May 9, 1989

INVENTOR(S) : Nicholas J. STEELE

It is certified that error appears in the above-identified patent and that said Letters Patent is hereby corrected as shown below:

Title page: [76], change "Charmian N. Steele" to --Nicholas J. Steele--.

Signed and Sealed this

Twenty-third Day of January, 1990

*Attest:*

JEFFREY M. SAMUELS

*Attesting Officer*

*Acting Commissioner of Patents and Trademarks*